US008911106B2

(12) United States Patent
Sato et al.

(10) Patent No.: US 8,911,106 B2
(45) Date of Patent: Dec. 16, 2014

(54) SURFACE ILLUMINATION FIXTURE AND SURFACE ILLUMINATION DEVICE

(75) Inventors: Eiichi Sato, Hachioji (JP); Hiroyasu Sato, Hachioji (JP); Rihito Sato, Hachioji (JP)

(73) Assignee: Opto Design, Inc. (JP)

( * ) Notice: Subject to any disclaimer, the term of this patent is extended or adjusted under 35 U.S.C. 154(b) by 130 days.

(21) Appl. No.: 13/642,776

(22) PCT Filed: Apr. 22, 2011

(86) PCT No.: PCT/JP2011/059986
§ 371 (c)(1),
(2), (4) Date: Oct. 22, 2012

(87) PCT Pub. No.: WO2011/132787
PCT Pub. Date: Oct. 27, 2011

(65) Prior Publication Data

US 2013/0044480 A1 Feb. 21, 2013

(30) Foreign Application Priority Data

Apr. 23, 2010 (JP) ..... 2010-100348
Apr. 28, 2010 (JP) ..... 2010-104526

(51) Int. Cl.

| | |
|---|---|
| ***F21V 7/04*** | (2006.01) |
| ***F21S 8/06*** | (2006.01) |
| *F21Y 101/02* | (2006.01) |
| *F21Y 103/02* | (2006.01) |

(52) U.S. Cl.
CPC ..... *F21S 8/061* (2013.01); *F21Y 2101/02* (2013.01); *F21Y 2103/022* (2013.01)
USPC ..... 362/241; 362/247; 362/307; 362/97.1

(58) Field of Classification Search
CPC ..... G02B 6/00; G02B 6/0001; G02B 6/0011; G02B 6/0033; G02B 6/0035; G02B 6/005; G02B 6/0051; G02B 6/0055; G02B 6/0058; G02B 6/0061; F21S 8/00; F21S 8/03; F21S 8/04; F21S 8/06; F21S 8/061; F21S 8/068; F21V 21/00; F21V 21/008; F21V 19/00; F21Y 2103/02; F21Y 2103/022; F21Y 2101/00; F21Y 2101/02
USPC ..... 362/235, 237, 240, 241, 247, 248, 362/249.01, 249, 2, 249.06, 249.14, 147, 362/404, 97.1–97.4, 297, 307, 311.02, 346
See application file for complete search history.

(56) References Cited

U.S. PATENT DOCUMENTS

| | | | | |
|---|---|---|---|---|
| 8,408,752 | B2 * | 4/2013 | Sato et al. | 362/303 |
| 8,672,498 | B2 * | 3/2014 | Bae et al. | 362/97.1 |
| 2007/0159573 | A1 | 7/2007 | Lee et al. | |
| 2009/0003002 | A1 * | 1/2009 | Sato | 362/341 |
| 2009/0201679 | A1 | 8/2009 | Konaka | |
| 2010/0061096 | A1 | 3/2010 | Sato | |

FOREIGN PATENT DOCUMENTS

| | | | |
|---|---|---|---|
| CN | 101000427 | A | 7/2007 |
| CN | 101375095 | A | 2/2009 |
| EP | 2172697 | A1 | 4/2010 |
| JP | 2005-251660 | A | 9/2005 |
| JP | 2007-188886 | A | 7/2007 |
| JP | 2008-077899 | A | 4/2008 |
| JP | 2008-311026 | A | 12/2008 |
| JP | 2009-026709 | A | 2/2009 |
| JP | 2009-110977 | A | 5/2009 |
| KR | 10-2007-0074951 | A | 7/2007 |
| KR | 10-2008-0099281 | A | 11/2008 |
| KR | 10-2009-0061682 | A | 6/2009 |
| KR | 10-0925098 | B1 | 11/2009 |
| WO | WO-2007/086347 | A1 | 8/2007 |
| WO | WO-2009/013858 | A1 | 1/2009 |

OTHER PUBLICATIONS

OTHER PUBLICATIONS

"International Application Serial No. PCT/JP2011/059986, International Preliminary Report on Patentability mailed May 18, 2012", 5 copies.

"International Application Serial No. PCT/JP2011/059986, International Search Report mailed Jun. 14, 2011", (w/ English Translation), 5 pgs.

* cited by examiner

*Primary Examiner* — Thomas M Sember
(74) *Attorney, Agent, or Firm* — Schwegman Lundberg & Woessner, P.A.

(57) ABSTRACT

[Purpose] To provide a surface illumination fixture using a point light source having strong directivity.
[Constitution] In the surface illumination fixture 3 including a surface illumination light-source device 6 converting light from a plurality of point light sources 36 having strong directivity into surface illumination and an illumination fixture main body 41, the surface illumination light-source device 6 includes a casing 30 having a flat plate part 35 being used to attach the surface illumination light-source device to the illumination fixture main body, lateral plate parts standing from the flat plate part, and an opening on a surface opposite to the flat plate part, and includes a light-guide reflection plate covering the opening. The flat plate part 35, the lateral plate parts 32 and 33, and the light-guide reflection plate 40 are formed by members having a high light reflectance and a low light transmittance. The light-guide reflection plate 40 is formed to have a lower light reflectance and a higher light transmittance as the distance from the corresponding point light source increases. The illumination fixture main body 41 having attaching means for attachment to a ceiling or a wall.

14 Claims, 20 Drawing Sheets

Fig.4
Fig. 4A
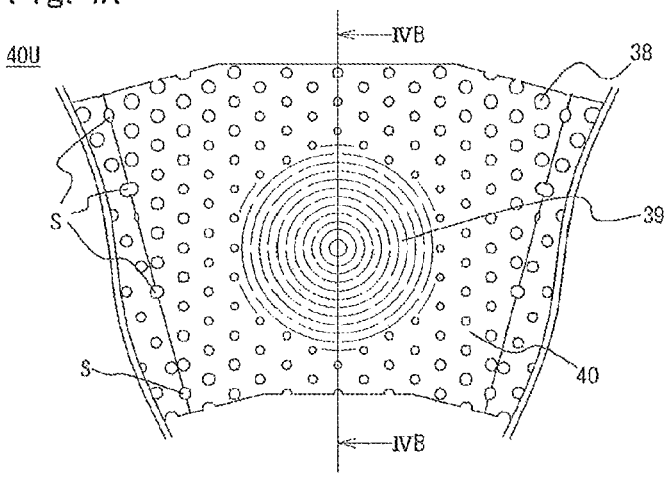
Fig. 4B
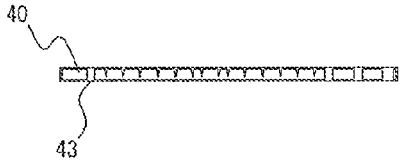

Fig.6
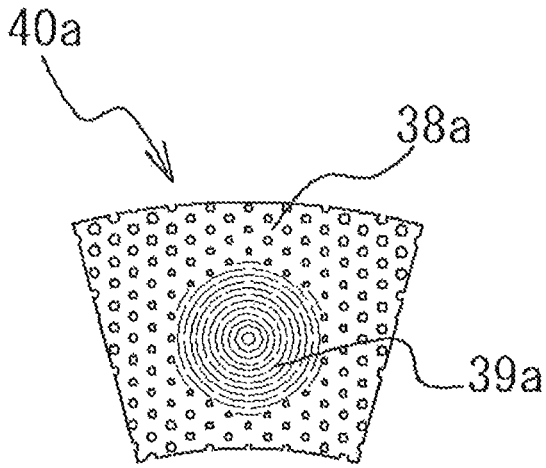
Fig. 6A
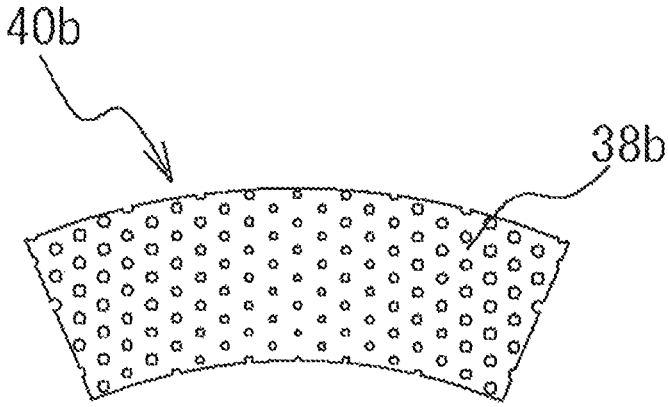
Fig. 6B

Fig.10
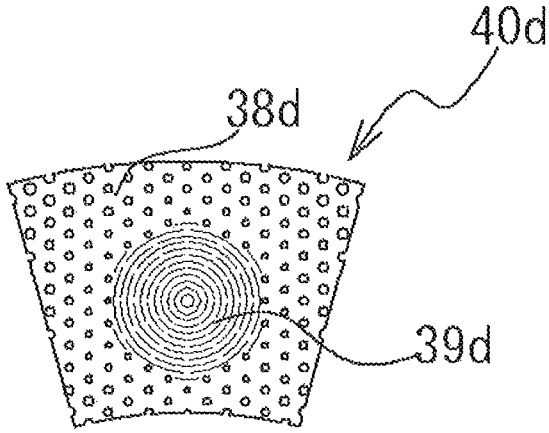
Fig. 10A
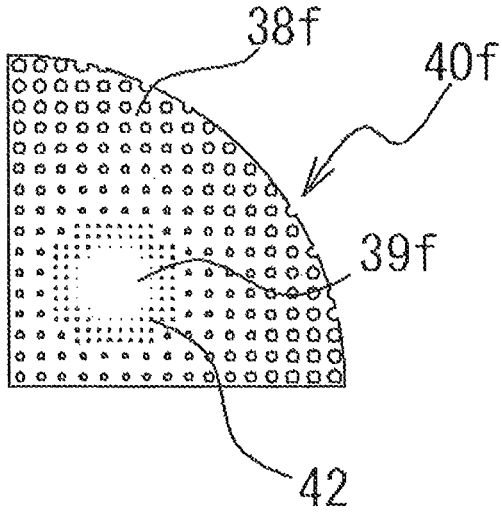
Fig. 10B

Fig.12
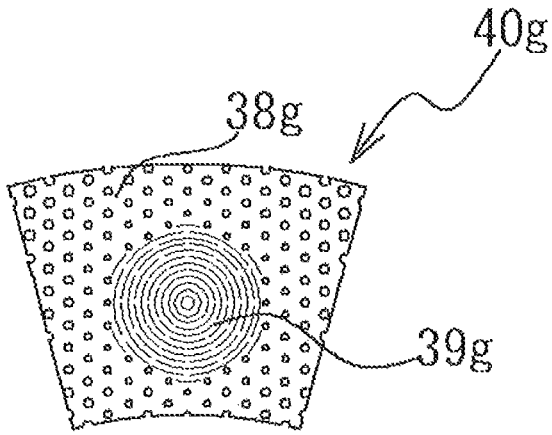
Fig. 12A
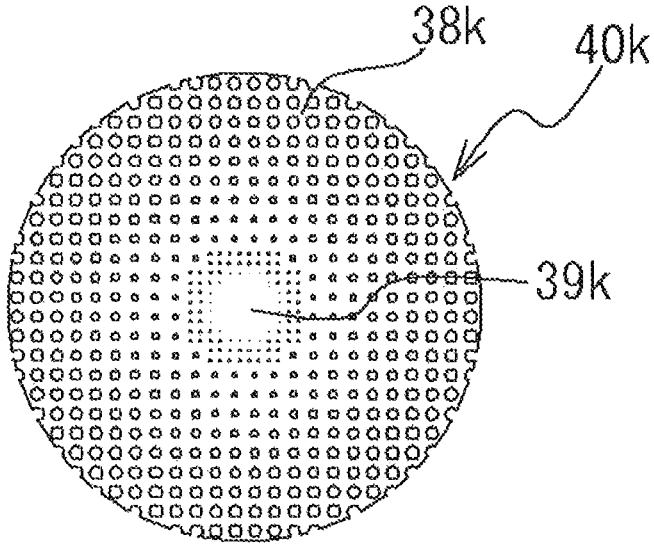
Fig. 12B

Fig.13
Fig. 13A
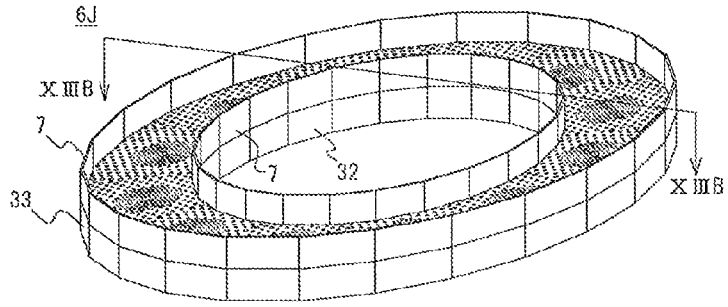
Fig. 13B
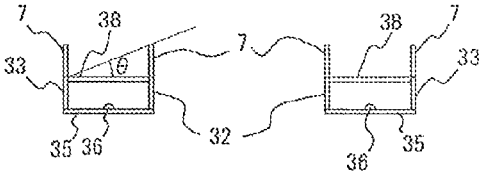
Fig. 13C
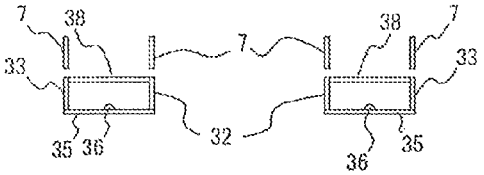

Fig.17
Fig. 17A
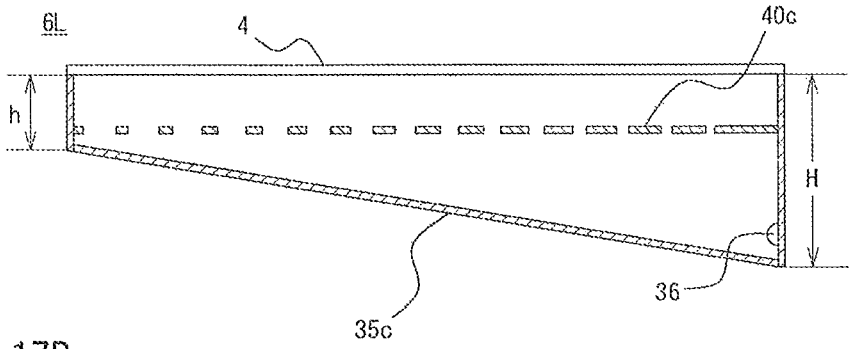
Fig. 17B
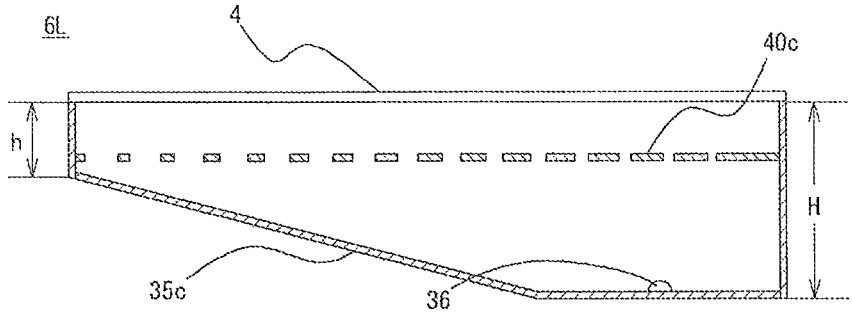

SURFACE ILLUMINATION FIXTURE AND SURFACE ILLUMINATION DEVICE

RELATED APPLICATIONS

This application is a nationalization under 35 U.S.C. 371 of PCT/JP2011/059986, filed Apr. 22, 2011, and published as WO 2011/132787 A1 on Oct. 27, 2011, which claims priority to Japanese Patent Application Serial No. 2010-100348, filed Apr. 23, 2010 and Japanese Patent Application Serial No. 2010-104526, filed Apr. 28, 2010, which applications and publication are incorporated herein by reference in their entirety.

TECHNICAL FIELD

The present invention relates to a surface illumination fixture using a point light source having strong directivity and a surface illumination device using the fixture.

BACKGROUND ART

In recent years, point light sources such as light emitting diodes (LED) and laser diodes have been used as light sources for various display devices, illumination devices, and others in place of incandescent bulbs and fluorescent tubes because such point light sources consume less electricity, generate less heat, and have longer service life.

There are various illumination devices using a point light source. Examples of such illumination devices include square and round illumination devices that are attached to a ceiling or a wall in a building to be used for, for example, room illumination, a miniature bulb-type illumination device used as, for example, an outdoor lamp, and a linear illumination device similar to a fluorescent lamp. Recently, LED illumination devices having an incandescent bulb shape, a linear fluorescent lamp shape, and an annular fluorescent lamp shape have been developed so that such an LED illumination device can be used in place of related art incandescent bulbs or fluorescent lamps.

A surface illumination device that makes light emitted from a point light source uniform on a predetermined surface is classified into a so-called backlight-type device in which a light source is disposed behind an illumination surface to face to the illumination surface and a so-called edge light-type device in which an illumination surface is orthogonal to a light source. The edge light-type surface illumination device typically employs a light guide plate and can be made thinner. The light guide plate is, however, required to be provided all over an illumination surface, thereby increasing the weight and the production cost. In contrast, some backlight-type surface illumination devices do not need the light guide plate. Such a case enables weight reduction. The backlight-type surface illumination device is therefore used at a place where weight reduction is required. LEDs and laser diodes are, however, point light sources having strong directivity, thereby generating strong light in an optical axis direction, namely, so-called glare. Thus, in order to provide uniform light distribution over a wide surface as an illumination device, various improvements are required.

For example, as an LED illumination device having a fluorescent lamp shape using a point light source, Patent Document 1 (JP-A-2008-77899) discloses a technique for an LED lamp that includes a reflection plate in a linear or annular outer shell case having a U shape in section and having an opening on one face, an LED attached to a bottom of the reflection plate, and a diffusion sheet for diffusing light provided near the opening of the outer shell case.

FIG. 19 is a sectional view of the LED lamp described in Patent Document 1. In the LED lamp 101, a reflection plate 103 is disposed on an opening side of an elongated outer shell case 102 having a U shape in section so that light is emitted toward the opening. In the reflection plate 103, a plurality of LED modules 105 in which an LED 105*a* is attached to a substrate 105*b* are linearly disposed. Around the LED module 105, a reflector 105*c* made of resin or metal optimally designed so as to efficiently reflect light in the opening direction is provided. A diffusion sheet 104 for diffusing light is attached to the opening of the outer shell case 102 to convert LED light into a linear light source or an omnidirectional light source. This invention can provide an LED lamp in which the number of LEDs to be used is reduced, and that can be used in place of a linear or annular fluorescent lamp.

Patent Document 2 (JP-A-2005-251660) discloses, as shown in FIG. 20, an illumination device 201 in which annular light sources are concentrically disposed. The illumination device 201 includes a metal substrate 209 having an annular outer shape and having an open space part 211 for disposing a luminous body 210, annular light sources 202 to 204 including LEDs 219 and luminous bodies 210 that are arranged in the open space part 211 and are in contact with the metal substrate 209, and a metal main body 205 that has a bottom face in contact with back faces of the annular light sources and in which the annular light sources are arranged so that an inner peripheral face of one of the annular light sources is in contact with an outer peripheral face of another annular light source, or one of the annular light sources is in contact with a side face 229 or 230. The annular light sources 202 to 204 are provided with, in the open space part, a metal cover 206 that is opposed to the LED 219 and has holes 227 through which light emitted from the LED can be passed.

CITATION LIST

Patent Documents

[Patent Document 1] JP-A-2008-77899
[Patent Document 2] JP-A-2005-251660

DISCLOSURE OF INVENTION

Problem to be Solved by the Invention

As described above, in the LED lamp disclosed in Patent Document 1, the diffusion sheet for diffusing light is attached to the opening of the outer shell case to convert LED light into a linear light source or an omnidirectional light source. The diffusion sheet 104 independently attached to the LED module 105 cannot, however, provide uniform surface illumination light. In the illumination device disclosed in Patent Document 2, the annular light source is provided with, in the open space part, the metal cover that is opposed to the LED and has holes through which light omitted from the LED can be passed. An LED, however, has strong directivity and emits strong light in an optical axis direction. Hence, direct sight of the illumination devices disclosed in Patent Documents 1 and 2 raises a problem in which strong light is viewed in an optical axis direction to cause so-called glare. The illumination devices disclosed in Patent Documents 1 and 2 emit light in the direction facing an LED alone and do not output sufficient light in a lateral direction due to strong directivity of the LED. There is therefore a problem in which it is difficult for such an illumination device to illuminate a whole room.

The annular surface illumination device disclosed in Patent Document 2 cannot provide uniform illumination intensity because a blank part of the point light sources remains as a center opening. In the illumination device in Patent Document 2, a plurality of annular light sources each having the metal substrate 209 for good heat dispersion are concentrically disposed on the metal main body 205. This complicates the structure of the illumination device and in particular, weight reduction cannot be achieved.

The illumination devices disclosed in Patent Documents have no contingency planning. In case of fire in a building where the illumination device is installed, a second disaster may be caused if, for example, a member constituting the illumination device is burned and melted, and the melted member falls to cause a burn injury.

The inventors of the present invention have carried out various studies in order to solve the problems and, as a result, the invention has been accomplished.

That is, it is an object of the invention is to provide a surface illumination fixture and a surface illumination device that use light from a point light source having strong directivity, but do not cause so-called glare, and can provide uniform illumination light on a face set apart from an emitting surface by a predetermined distance while using light from a light source at high efficiency.

Another object of the invention is to provide a surface illumination fixture and a surface illumination device that use light from a point light source having strong directivity, can output sufficient light not only in a direction to which an LED faces but also in a lateral direction, and can easily provide uniform illumination light to the whole surface illumination fixture.

Another object of the invention is to provide a surface illumination fixture capable of simplifying the structure of an illumination device. Another object of the invention is to provide a surface illumination fixture and a surface illumination device that use light from a point light source having strong directivity, do not include a blank part of the point light sources remaining as a center opening, and can provide uniform illumination intensity in the entire area.

Another object of the invention is to provide a surface illumination fixture and a surface illumination device that do not cause a second disaster when a disaster happens in a building where the illumination device is installed.

Means for Solving Problem

The invention employs the aspects below in order to solve the problems. That is, a surface illumination fixture of a first aspect of the invention includes a surface illumination light-source device converting light from a point light source having strong directivity into surface illumination and an illumination fixture main body holding the surface illumination light-source device. In the surface illumination fixture, the surface illumination light-source device includes a casing having a flat plate part being used to attach the surface illumination light-source device to the illumination fixture main body, a lateral plate part standing from the flat plate part, and an opening on a surface opposite to the flat plate part, and includes a plurality of such point light sources disposed on the flat plate part, and a light-guide reflection plate covering the opening. The casing and the light-guide reflection plate are formed by members having a high light reflectance and a low light transmittance. The light-guide reflection plate is divided into regions corresponding to the point light sources and each region is formed to have a lower light reflectance and a higher light transmittance as the distance from the corresponding point light source increases.

According to a second aspect of the invention, in the surface illumination fixture of the first aspect, the casing and the light-guide reflection plate are formed into an annular shape.

According to a third aspect of the invention, in the surface illumination fixture of the first aspect, the casing and the light-guide reflection plate are formed into a disc shape.

According to a fourth aspect of the invention, in the surface illumination fixture of any one of the first to third aspects, the casing includes partition plates dividing the point light sources and standing from the flat plate part in an upright manner, and the partition plates divide the casing into segments.

According to a fifth aspect of the invention, in the surface illumination fixture of the fourth aspect, each segment is formed to have the same size and the same shape.

According to a sixth aspect of the invention, in the surface illumination fixture of the first aspect, each of the casing and the light-guide reflection plate has a surface coated with a flame-retardant light-transmissive material.

According to a seventh aspect of the invention, in the surface illumination fixture of the second aspect, a plurality of such surface illumination light-source devices are concentrically disposed.

According to an eighth aspect of the invention, in the surface illumination fixture of the second or seventh aspect, a lighting device for a point light source is attached to a center opening of the casing of the surface illumination light-source device disposed to the illumination fixture main body.

According to a ninth aspect of the invention, in the surface illumination fixture of the first aspect, the casing and the light-guide reflection plate are formed by an ultrafinely foamed reflection member.

According to a tenth aspect of the invention, in the surface illumination fixture of the first aspect, the surface illumination light-source device includes both the casing and the light-guide reflection plate each having an annular shape, and the casing and the light-guide reflection plate each having a disc shape.

According to an eleventh aspect of the invention, the surface illumination fixture of the first aspect further includes a light shielding plate having a predetermined height and standing from the lateral plate part in an upright manner.

According to a twelfth aspect of the invention, in the surface illumination fixture of the eleventh aspect, a gap is provided between the light shielding plate and the lateral plate part.

According to a thirteenth aspect of the invention, a surface illumination device includes the surface illumination fixture of any one of the first to twelfth aspects and a diffusion plate disposed on a front face of the surface illumination fixture.

According to a fourteenth aspect of the invention, the surface illumination device of the thirteenth aspect further includes a cover on a back face of the surface illumination fixture.

According to a fifteenth aspect of the invention, the surface illumination device of the thirteenth or fourteenth aspect further includes a panel on a front face of the diffusion plate.

Effect of the Invention

In the surface illumination fixture of the invention, the casing and the light-guide reflection plate are formed by a member having a high light reflectance and a low light transmittance, the light-guide reflection plate is divided into regions corresponding to the point light sources, each region is formed to have a lower light reflectance and a higher light transmittance as the distance from the corresponding point light source increases. Even when a point light source having strong directivity, such as an LED is therefore used as the light source, a surface illumination fixture that uses light from the point light source at high efficiency and can provide uniform illumination light on a face set apart from an emitting surface of the point light source by a predetermined distance while suppressing the generation of glare in a light emitting direction, can be provided at low cost.

With the surface illumination fixture of the invention, an annular surface illumination fixture in which the casing and the light-guide reflection plate are formed into an annular shape, and that provides the advantageous effects, can be provided.

With the surface illumination fixture of the invention, a disc-shaped surface illumination fixture in which the casing and the light-guide reflection plate are formed into a disc shape and that provides the advantageous effects, can be provided.

In the surface illumination fixture of the invention, both the casing and the light-guide reflection plate have a surface coated with a flame-retardant light-transmissive material. In case of fire or other emergency in a building where the surface illumination fixture is installed, the surface illumination fixture is unlikely to be burned, thereby preventing a second disaster.

In the surface illumination fixture of the invention, a plurality of such annular surface illumination light-source devices can be concentrically disposed. Such a surface illumination fixture can provide the advantageous effects and can change the luminance depending on the purpose, thereby increasing the width of surface illumination.

With the surface illumination fixture of the invention a larger disc-shaped surface illumination fixture that can provide the advantageous effects and has no blank part of point light sources at the center part can be obtained by the combination of the annular surface illumination fixture and the disc-shaped surface illumination fixture. Furthermore, even a large surface illumination fixture can be lightened because the casing is lightweight.

With the surface illumination fixture of the invention, an illumination area can be limited and an area that is expected to be illuminated alone can be illuminated by attaching the light shielding plate onto a light-guide reflection plate side of the casing, thereby reducing the probability of direct sight of an emitting face. Such a surface illumination fixture can therefore reduce the burden of light placed on the eyes.

With the surface illumination device of the invention, a surface illumination device that can provide the advantageous effects of the surface illumination fixture can be obtained.

BRIEF DESCRIPTION OF DRAWINGS

FIG. 4A is an enlarged plan view of the part IV in FIG. 3 and FIG. 4B is a sectional view taken along the line IVB-IVB in FIG. 4A.

FIG. 6 is a partially enlarged plan view of the light-guide reflection plate in FIG. 5.

FIG. 10 is a partially enlarged plan view of a light-guide reflection plate in the surface illumination light-source device in FIG. 9.

FIG. 12 is a partially enlarged plan view of a light-guide reflection plate in the surface illumination light-source device in FIG. 11.

FIG. 13 is an exterior perspective view of a surface illumination light-source device of a fourth embodiment, FIG. 13B is a sectional view taken along the line XIIIB-XIIIB in FIG. 13A, and FIG. 13C is a sectional view of an alternative example.

FIG. 17A is a sectional view taken along the line XVI-XVI in FIG. 15 and FIG. 17B is a sectional view of an alternative example.

BEST MODES FOR CARRYING OUT THE INVENTION

Various embodiments of the invention will now be described in detail with reference to the accompanying drawings. The embodiments shown below are, however, illustrative examples of the illumination fixture and the illumination device for embodying the technical spirit of the invention, are not intended to limit the invention to the illumination fixtures and the illumination devices, and may equally be applied to other embodiments within the scope of the claims.

First Embodiment

Figures 1, 1A, 1B:
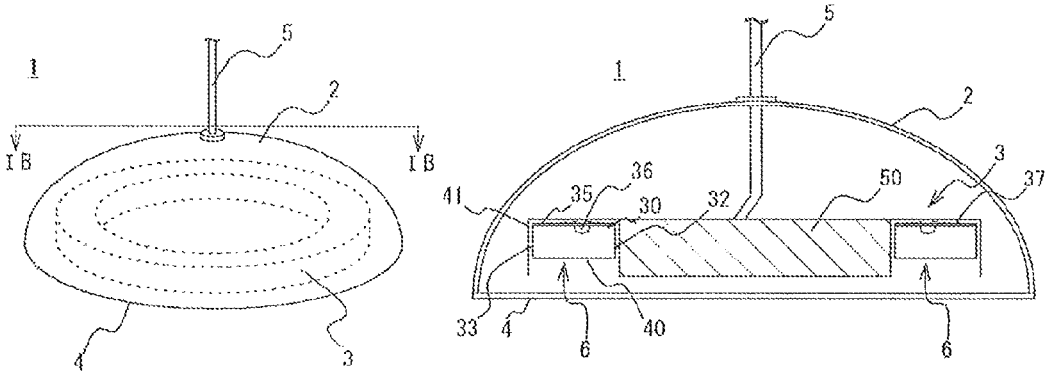
FIG. 1A is an exterior perspective view of a surface illumination device of a first embodiment of the invention and FIG. 1B is a sectional view taken along the line IB-IB in FIG. 1A.

With reference to FIG. 1, an overview of a surface illumination device of a first embodiment of the invention will be described. FIG. 1A is an exterior view of a pendant surface illumination device for home use as an embodiment of the invention. A surface illumination device 1 includes a surface illumination fixture 3, an illumination cover 2 having an umbrella shape attached to the surface illumination fixture 3 so as to cover the surface illumination fixture 3 from the above, and a diffusion plate 4 closing an opening of the illumination cover 2. The illumination cover 2 has a spherical shape that is partially cut out and is attached with a round-shaped diffusion plate 4 so as to close an opening that is the cut-out part. An adapter (not shown in the drawings) for connecting a power supply and a hanging cord 5 are also attached to the illumination cover 2 for hanging the surface illumination fixture 3 from a ceiling and for supplying electric power to a surface illumination light-source device 6.

FIG. 1B is a sectional view taken along the line IB-IB in FIG. 1A and shows that the surface illumination light-source device 6 includes point light sources 36, a casing 30 having the point light sources 36, a light-guide reflection plate 40 closing an opening of the casing 30, and an illumination fixture main body 41 holding these component members. A lighting circuit 50 for activating the point light sources 36 of the surface illumination light-source device 6 is attached to the center part of the illumination fixture main body 41.

In other words, the surface illumination fixture 3 of the first embodiment includes the surface illumination light-source device 6 for converting light from the point light source 36 having strong directivity into surface illumination and the illumination fixture main body 41 holding the surface illumination light-source device 6.

Figure 2:
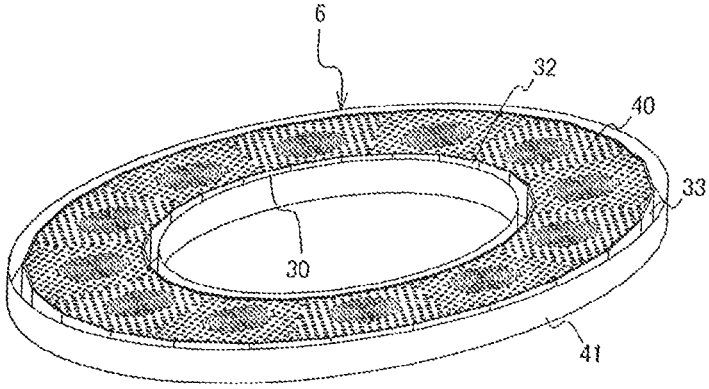
FIG. 2 is an exterior perspective view of the surface illumination light-source device of the first embodiment of the invention viewed from the front side.
Figure 3:
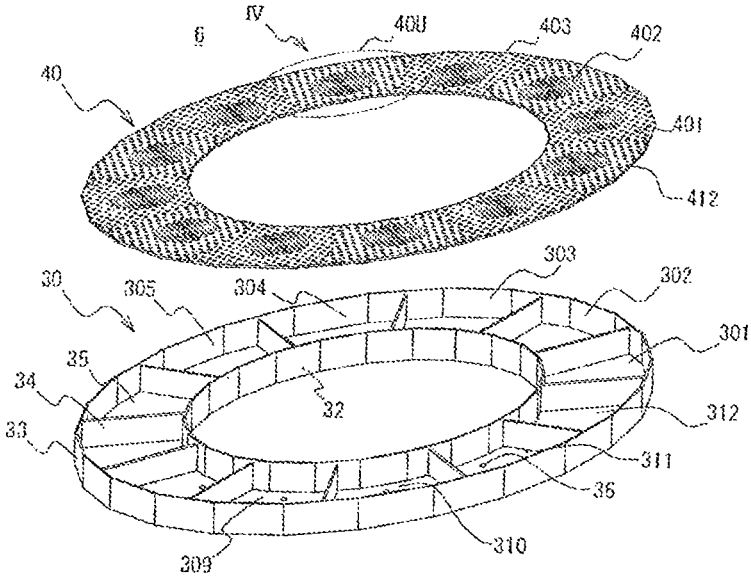
FIG. 3 is an exploded perspective view of the surface illumination light-source device in FIG. 2.

Next, with reference to FIG. 2 and FIG. 3, the surface illumination light-source device 6 will be described. FIG. 2 shows an exterior perspective view of the surface illumination light-source device 6 in the first embodiment viewed from the front face where the top and bottom of the surface illumination light-source device 6 attached in FIG. 1 are reversed and FIG. 3 is an exploded perspective view showing the inside of the surface illumination light-source device 6 in FIG. 2. The lighting circuit 50 is not shown in the drawings.

The surface illumination light-source device 6 includes a plurality of point light sources 36 having strong directivity, the casing 30 having the point light sources 36, and the light-guide reflection plate 40. The casing 30 has a flat plate part 35 and lateral plate parts standing from the flat plate part 35, namely, an outer lateral plate part 33 and an internal lateral plate part 32 standing from the flat plate part 35 in an upright manner, and has partition plates 34 and an opening on a surface opposite to the flat plate part 35. The flat plate part 35 has holes for disposing the point light sources 36. The opening of the casing 30 is closed with the light-guide reflection plate 40. The light-guide reflection plate 40 is supported by the outer lateral plate part 33, the internal lateral plate part 32, and the partition plates 34 of the casing, and is attached so as to close the opening of the casing. The surface illumination light-source device 6 is attached to the illumination fixture main body 41 through the flat plate part 35 of the casing 30 to constitute the surface illumination fixture 3, as shown in FIG. 1.

The point light source 36 employs a light emitting diode (LED) or a laser diode (LD) that is a point light source having strong directivity. The light emitting diode or the laser diode is used standalone, or a plurality of light emitting diodes or the laser diodes are assembled to be used.

The point light source 36 is disposed on a substrate 37 (see FIG. 1) to be modularized. The substrate 37 having the point light source is made of a material having high heat conductivity, for example, aluminum, in order not to raise the temperature of the point light source 36. The substrate 37 used in the first embodiment is an aluminum substrate that is prepared by coating the surface of an aluminum plate with an insulating material and by forming an electrical connection part with a copper foil on the surface of the insulating material. Alternatively, the substrate may be an aluminum plate attached with a flexible printed circuit board.

The casing 30 includes the partition plates 34 standing from the flat plate part 35 in an upright manner so as to divide a plurality of point light sources 36 attached into the casing 30. By the partition plates 34, the inside of the casing 30 is divided into segments 301 to 312 and each segment is formed to have the same size and the same shape. In the drawings below, the sign of each segment may not be shown.

In each of the segments 301 to 312 in the casing 30, one point light source 36 is disposed. The point light source is disposed at the center of each segment. The point light source 36 may, however, be disposed at a position close to the internal lateral plate part 32 from the center of each segment. When the point light source 36 is disposed at a position close to the internal lateral plate part 32, light readily reaches the inside of the annular ring of the annular illumination fixture at which no point light source is disposed, thereby enabling more uniform illumination over the entire illumination area.

Exemplifying a specific size of the casing 30, the shape of the flat plate part 35 is a so-called doughnut shape that is a 3-cm regular icosikaitetragon from which a 1.7-cm regular icosikaitetragon having the same shape but a reduced size is concentrically hollowed. On the outer side of the doughnut shape, an outer lateral plate part 33 having a height of 1 cm stands in an upright manner, while on the inner side, the internal lateral plate part 32 having a height of 1 cm stands in an upright manner. The partition plates 34 also stand from the flat plate part 35 in an upright manner across the inside of the casing 30 so as to divide the inside of the casing 30 into twelve equal parts. The partition plate 34 also has a height of 1 cm as with the outer lateral plate part 33 and the internal lateral plate part 32. The segments 301 to 312 are formed in the casing 30 by the outer lateral plate part 33, the internal lateral plate part 32, and the partition plates 34. The partition plate 34 has a hook (not shown in the drawings) at the upper edge and the hook is engaged with an opening for controlling light transmittance provided on the light-guide reflection plate 40, thereby mechanically connecting the partition plates 34 to the light-guide reflection plate 40.

The light-guide reflection plate 40 will be described with reference to FIG. 3 and FIG. 4. FIG. 4A is a partially enlarged view of the light-guide reflection plate 40 in the first embodiment and is an enlarged plan view of a region IV encircled in FIG. 3, namely, a light-guide reflection unit 40U and FIG. 4B is a sectional view taken along the line IVB-IVB in FIG. 4A.

The light-guide reflection plate 40 is, as described above, supported by the outer lateral plate part 33, the internal lateral plate part 32, and the partition plates 34 of the casing 30. The light-guide reflection plate 40 that is attached so as to close the opening of the casing 30 is divided into regions corresponding to each point light source to correspond to each of the segments 301 to 312 in which the point light source 36 is disposed. Each region is formed so as to have a lower light reflectance and a higher light transmittance as the distance from each corresponding point light source increases. In the first embodiment, the light-guide reflection plate 40 includes twelve regions 401 to 412 that are connected to each other. Each of the regions 401 to 412 is a light-guide reflection unit 40U having the same pattern of openings for passing light as one region. In the drawings below, each region may be shown with no sign.

The light-guide reflection unit 40U includes a center reflection part 39 having arc-shaped grooves that are concentrically formed and have the center right above the point light source 36 and an outer reflection part 38 around the center reflection part 39 having round holes. The arc-shaped grooves and the round holes are formed by punching or with a cutting plotter. The size of the opening provided on the light-guide reflection unit 40U is designed so as to increase the ratio of the opening area with respect to a certain region as the distance from the center increases. The arc-shaped grooves provided around right above the point light source 36 may not penetrate the unit. When the arc-shaped grooves provided around right above the point light source 36 do not penetrate the unit, direct light from the point light source 36 is not output from the surface illumination fixture, thereby eliminating direct sight of light. The outside of the outer reflection part 38 has openings S with which hooks (not shown in the drawings) provided on the upper edge of the partition plate 34 are engaged, thereby fixing and connecting the partition plate.

In particular, the width and the length of the arc-shaped groove and the size of the round hole are designed so as to generally satisfy the equation $$A=bx^2+c \quad (1)$$

where the opening area ratio with respect to a certain region is A, the distance from the center of the light-guide reflection unit 40U is x, and b and c are constants.

When the grooves and the like on the center part of the center reflection part 39 do not penetrate the unit, light from the point light source 36 is not directly output, thereby suppressing the generation of so-called glare. The arc-shaped grooves do not necessarily have an arc shape and may be, for example, grooves having a concentric polygonal shape as long as such grooves have a width and a length satisfying the equation (1). The round holes provided on the outer lateral plate part 33 do not necessarily have a round shape and may have any shape, for example, a triangular shape, a quadrangular shape, and a star shape as long as such holes have a size satisfying the equation (1).

In the first embodiment, the openings provided on the light-guide reflection plate 40 are alternately arranged in a staggered pattern but may be arranged in an orthogonal grid pattern or a hexagonal grid pattern. The layout of each opening can be variously selected.

The flat plate part 35, the outer lateral plate part 33, the internal lateral plate part 32, and the partition plates 34 of the casing 30 and the light-guide reflection plate 40 desirably employ a member having a high light reflectance and a low light transmittance. Examples of the member include an ultrafinely foamed reflection plate (MCPET: light reflectance 98%, light transmittance 1%, optical absorbance 1%) that is formed by an ultrafinely foamed resin having characteristics of high light reflectance and low light transmittance, an emulsion of titanium white particles, polytetrafluoroethylene (polyfluorocarbon) particles, or a combination of these. The member preferably has a reflectance of 95 to 98% and a light transmittance of 2 to 5%.

The surface of the light-guide reflection plate 40 is uniformly coated with a flame-retardant light-transmissive material 43. The ultrafinely foamed resin used as the light-guide reflection plate 40 may cause a second disaster in case of fire and the like because the ultrafinely foamed resin is readily flammable. In the surface illumination fixture 3 of the first embodiment, the flame-retardant light-transmissive material 43 is applied onto the surface, and hence, the surface illumination fixture is not readily flammable even in case of fire and the like, thereby preventing a second disaster from happening. The flame-retardant light-transmissive material 43 is also applied onto the flat plate part 35, the outer lateral plate part 33, the internal lateral plate part 32, and the partition plates 34 of the casing 30 in a similar manner.

The member used for the flame-retardant light-transmissive material 43 is a member that is not readily flammable and has a high light reflectance. Examples of the member include a paraxylylene resin and a polytetrafluoroethylene resin. The flame-retardant light-transmissive material 43 is applied by a method, for example, by coating with a spray or immersion into a resin. A coating of the flame-retardant light-transmissive material 43 having a large thickness alters optical characteristics of the light-guide reflection plate 40 and uniform illumination intensity cannot be obtained. The flame-retardant light-transmissive material 43 is therefore preferably applied so as to make the thickness as small as possible. In the embodiment, the thickness is about ten micrometers.

In the surface illumination fixture 3 of the first embodiment, to the center opening of the illumination fixture main body 41 provided with the annular casing 30 of the surface illumination light-source device 6, by using the space, a lighting device 50 for point light sources equipped with, for example, an AC-DC converter circuit and a voltage adjustment circuit may be attached. In this case, the surface illumination fixture 3 and the surface illumination device 1 can be formed into a compact disc shape.

The partition plates 34 do not necessarily divide every region, and may be provided every few point light sources 36, or may not be provided.

Alternative Example 1

An alternative example 1 of the first embodiment of the invention described above will be described with reference to FIG. 5. In the surface illumination fixture of the alternative example 1, a plurality of annular surface illumination light-source devices 6 having different diameters are concentrically disposed. The annular surface illumination light-source device 6 in the drawing is shown by the layout of the casings. In other words, in the example, the surface illumination device 1 includes two annular surface illumination light-source devices 6A and 6B in a double annular pattern. Such a structure can enlarge the area of the surface illumination device. The outside annular surface illumination light-source device 6A is divided into sixteen segments 313 to 328 and each segment includes one point light source 36*a*. The inside annular surface illumination light-source device 6B is divided into eight segments and each of the segments 329 to 336 includes one point light source 36*b*, but the disposed position of the point light source 36*b* is not the flat surface but the internal lateral plate 32*b*. The disposed positions of the point light sources 36*a* and 36*b* are, however, not limited to the flat plates 35*a* and 35*b* and the internal lateral plates 32*a* and 32*b*, but may be the outer lateral plates 33*a* and 33*b*. The illumination fixture main body 41 is not shown in the drawings.

Figure 5:
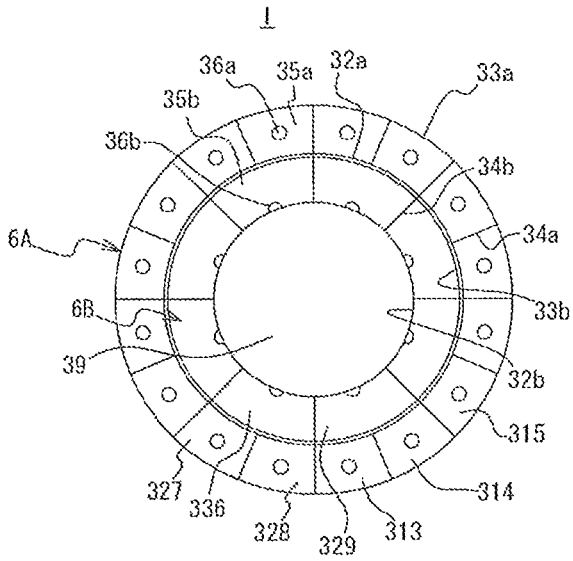
FIG. 5 is a plan view of a surface illumination device using a surface illumination light-source device of an alternative example of the first embodiment of the invention.

FIG. 6 is a partial plan view of the light-guide reflection plates 40*a* and 40*b* in the alternative example 1 in FIG. 5. FIG. 6A corresponds to a segment of the outside annular surface illumination light-source device 6A and FIG. 6B corresponds to a segment of the inside annular surface illumination light-source device 6B. These views show that, in the fan-shaped light-guide reflection unit 40U corresponding to a segment, light-guide reflection plates 40*a* and 40*b* have different unit patterns of openings for passing light depending on the disposed position of the point light source. In other words, in the case of the annular surface illumination light-source device 6A in which the point light source is disposed on the flat plate 35*a*, the center part 39*a* to which light emitted from the point light source is applied includes non-penetrating holes and the outer reflection part 38*a* includes round through-holes. In contrast, in the case of the annular surface illumination light-source device 6B in which the point light source is disposed on the internal lateral plate part 32*b*, the entire area of the light-guide reflection plate 40*b* includes round through-holes 38*b*. In this case, the through-hole 38*b* also has a small diameter near the point light source 36*b*.

In FIG. 5, the casing 30 has an annular outer shell. In actual production, however, the casing 30 is typically designed and produced to have a polygonal and approximately annular shape as shown in FIG. 3 and the first embodiment includes such a case.

According to the first embodiment, in the surface illumination light-source device 6, the casing 30 and the light-guide reflection plate 40 are formed by a member having a high light reflectance and a low light transmittance, and the light-guide reflection plate 40 is formed so as to have a lower light reflectance and a higher light transmittance as the distance from each point light source increases. The surface illumination fixture 3 that uses light from the point light source 36 at high efficiency and can provide uniform illumination light on a face set apart from an emitting surface of the point light source by a predetermined distance while suppressing the generation of glare in a light emitting direction, can be therefore provided at low cost.

According to the first embodiment, when the casing includes the partition plates that divide the point light sources and stand from the flat plate part in an upright manner and the partition plates divide the inside of the casing into segments, the casing obtains strong structure, a light reflection condition in each segment is improved, and uniform illumination light can be obtained. In this case, when each segment is formed to have the same size and the same shape, such a surface illumination fixture can provide illumination light having substantially uniform condition for light emission over the entire area.

According to the first embodiment, the surface illumination light-source device having the annularly formed casing and the annularly formed light-guide reflection plate can be replaced with a currently used illumination fixture using annular fluorescent lamps, and provides the possibility to produce new designs.

According to the first embodiment, a lighting device for point light sources can be attached to the center opening of the annular casing of the surface illumination light-source device disposed to the illumination fixture main body. In this case, the surface illumination fixture can be formed into a compact size.

According to the first embodiment, a plurality of illumination light-source devices having the annular casings can be concentrically disposed and the concentric arrangement can increase the width of surface illumination.

According to the first embodiment, in the surface illumination fixture, the casing and the light-guide reflection plate are preferably formed by an ultrafinely foamed reflection member in order to achieve expected effects of the invention from the viewpoints of easy production, lightweight, and good reflection performance.

Second Embodiment

Figure 7:
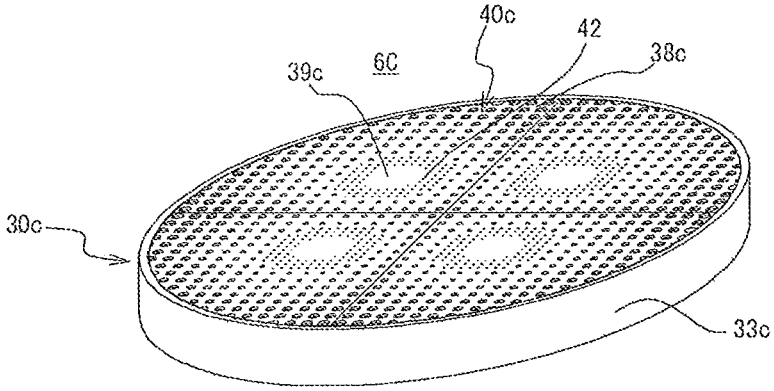
FIG. 7 is an exterior perspective view of a surface illumination light-source device of a second embodiment of the invention viewed from the front side.
Figure 8:
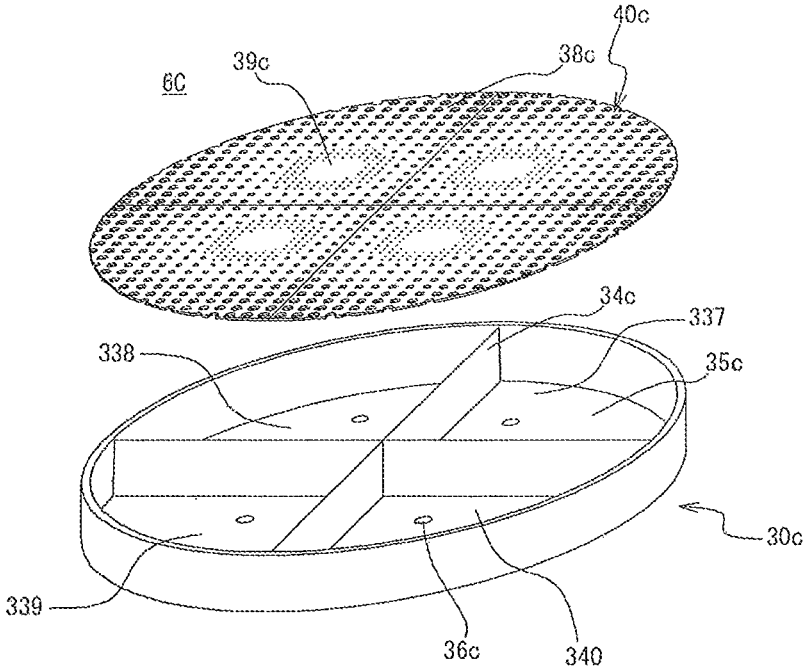
FIG. 8 is an exploded perspective view of the surface illumination light-source device in FIG. 7.

According to a second embodiment of the invention, in a surface illumination fixture 3, a surface illumination light-source device 6 includes a round casing 30*c* formed so as to have a round outer shell and a round light-guide reflection plate 40*c*. A surface illumination light-source device 6C in the second embodiment of the invention will be described hereinafter with reference to FIG. 7 and FIG. 8. FIG. 7 is an exterior perspective view of a surface illumination light-source device 6C used for a surface illumination device 1 in the second embodiment and FIG. 8 is an exploded perspective view of the surface illumination light-source device 6C. In the description below, the points overlapping with the first embodiment will be simplified.

The surface illumination device 1 of the second embodiment includes a round surface illumination light-source device 6C for converting light from the point light source 36 having strong directivity into surface illumination and an illumination fixture main body (not shown in the drawings) holding the round surface illumination light-source device 6C.

The round surface illumination light-source device 6C includes a plurality of point light sources 36*c* having strong directivity, a round casing 30*c* having the point light sources 36*c*, and a round light-guide reflection plate 40*c*. The round casing 30*c* has a flat plate part 35*c* and a lateral plate part standing from the flat plate part 35*c*, namely, an outer lateral plate part 33*c* standing from the flat plate part in an upright manner and has partition plates 34*c* in the inside and an opening on a surface opposite to the flat plate part 35*c*. The flat plate part 35*c* has holes for disposing the point light sources 36*c*. The opening of the round casing 30*c* is closed with the round light-guide reflection plate 40*c*. The round light-guide reflection plate 40*c* is supported by the outer lateral plate part 33*c* and the partition plates 34*c* of the round casing and is attached so as to close the opening of the round casing. The round surface illumination light-source device 6C is attached to the illumination fixture main body 41 through the flat plate part 35*c* of the round casing 30*c* to constitute the surface illumination fixture 3.

The point light source 36*c* employs a light emitting diode (LED) or a laser diode (LD) that is a point light source having strong directivity. The point light source 36*c* is disposed on a substrate 37 to be modularized. The substrate having the point light source is made of a material having high heat conductivity in order not to raise the temperature of the point light source 36*c*.

The round casing 30*c* includes the partition plates 34*c* standing from the flat plate part 35*c* in an upright manner so as to divide each point light source 36*c* in the round casing 30*c*. The inside of the round casing 30*c* is divided into segments 337 to 340 by the cruciform partition plate 34*c*, and each segment is formed to have the same size and the same shape. The partition plate 34*c* is not indispensable, but the partition plate makes the illumination intensity in each segment uniform and enhances the structural strength of the surface illumination light-source device 6C.

One point light source 36*c* is disposed in each of the segments 337 to 340 in the round casing 30*c*. The point light source 36*c* is disposed at a position closer to the center of the round surface illumination light-source device 6C than the center of each segment. When the point light source 36*c* is disposed at a position close the round center, the number of point light source can be reduced, light readily reaches the outside in the round casing 30 at which no point light source is disposed, thereby enabling more uniform illumination over the entire illumination area.

The round light-guide reflection plate 40*c* includes four light-guide reflection units 40U that correspond to the region of each of the segments 337 to 340, have the same pattern of openings, and are connected to each other. The light-guide reflection unit 40U includes a center reflection part 39*c* without through-holes on the light-guide reflection plate 40*c* right above the point light source 36*c* as the center, an intermediate reflection part 42 provided on the outside of the center reflection part 39*c* and having small round through-holes, and an outer reflection part 38*c* having round through-holes. The round holes are formed by punching or with a cutting plotter. The size of the opening provided on the light-guide reflection unit 40U is designed so as to increase the ratio of the opening area with respect to a certain region as the distance from the center part opposed to the point light source 36 increases. The outside of the outer reflection part 38*c* includes openings S with which hooks (not shown in the drawings) provided on the lateral plate 33*c* and the partition plate 34 are engaged. The hooks are engaged with the openings provided on the light-guide reflection plate 40*c*, and thereby mechanically connected to the light-guide reflection plate 40*c*.

In other words, in the light-guide reflection unit 40U, the size of the round hole is designed so as to generally satisfy the equation $$A=bx^2+c \quad (1)$$

where the opening area ratio with respect to a certain region is A, the distance from the center of the light-guide reflection unit 40U is x, and b and c are constants, as with the description in the first embodiment.

In the light-guide reflection unit 40U of the light-guide reflection plate 40*c*, when the center part of the center reflection part 39*c* includes non-penetrating holes, light from the point light source 36*c* is not directly output, thereby suppressing the generation of so-called glare. The round holes do not necessarily have a round shape and may be, for example, grooves having a concentric polygonal shape that have widths and lengths satisfying the equation (1). The hole may have any shape, for example, a triangular shape, a quadrangular shape, and a star shape as long as such a hole has a size satisfying the equation (1).

The casing 30*c* and the light-guide reflection plate 40*c* of the surface illumination light-source device 6C are formed by a member having a high light reflectance and a low light transmittance.

The second embodiment can provide a disc surface illumination device because the surface illumination light-source device includes the casing formed so as to have a round outer shell and the light-guide reflection plate in the surface illumination fixture of the invention.

Third Embodiment

Figure 9:
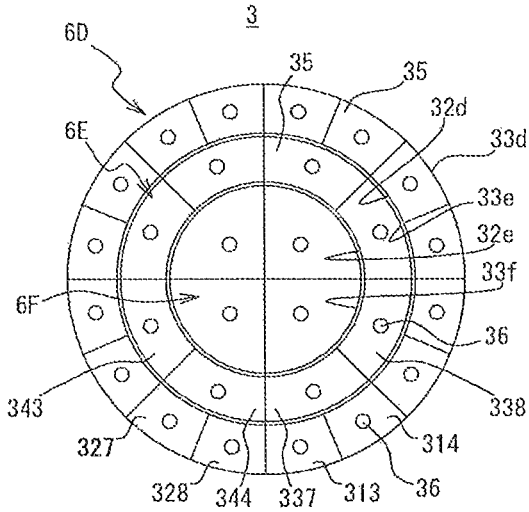
FIG. 9 is a plan view of a surface illumination light source device of a third embodiment of the invention.

Next, a surface illumination fixture 3 in a third embodiment will be described with reference to FIGS. 9 and 10. FIG. 9 shows the layout of casings. FIG. 10 is a partial plan view of light-guide reflection plates 40*d* and 40*f* in the third embodiment, providing plan views of the light-guide reflection unit 40U in FIG. 9.

According to the third embodiment of the invention, the surface illumination fixture 3 includes annular surface illumination light-source devices 6D and 6E that are formed into an annular shape, a round surface illumination light-source device 6F that is formed into a disc shape, and a disc-shaped illumination fixture main body (not shown in the drawings) holding these surface illumination light-source devices. By combination of the round surface illumination light-source device 6F formed into a disc shape and the annular surface illumination light-source devices 6D and 6E formed into an annular shape, a disc-shaped surface illumination fixture having no blank part of point light sources at the center part and having a larger illumination part can be obtained.

In the surface illumination fixture 3 of the third embodiment, a plurality of annular surface illumination light-source devices 6D and 6E having different diameters are concentrically disposed. In other words, in the example, a surface illumination device 1 includes two annular surface illumination light-source devices 6D and 6E in a double annular manner. Such a structure can enlarge the area of surface illumination. The outside annular surface illumination light-source device 6D is the same as that used in the second embodiment and is divided into sixteen segments 313 to 328 and each segment includes one point light source 36. The inside annular surface illumination light-source device 6E is divided into eight segments and each of the segments 337 to 344 includes one point light source 36. The disposed position of each point light source 36 is the flat plate 35.

In the surface illumination fixture 3 of the third embodiment, two annular surface illumination light-source devices 6D and 6E are disposed in the surface illumination fixture in a double annular manner so that lateral plates 32*d* and 33*e* of these casings are in contact with each other, and a disc-shaped round surface illumination light-source device 6F as shown in FIG. 7 is disposed in a center blank part of the surface illumination fixture so that lateral plates 32*e* and 33*f* of the casings are in contact with each other, thereby constituting the disc-shaped surface illumination fixture 3 with no blank part of illumination light.

FIG. 10 is a partially enlarged plan view of the light-guide reflection plate 40 in FIG. 9. The light-guide reflection plate 40*d* in FIG. 10A corresponds to a segment of the outside annular surface illumination light-source device 6D and is the same as that in FIG. 4. Although not shown in the drawings, a light-guide reflection plate corresponding to a segment of the intermediate annular surface illumination light-source device 6E has a similar structure to that corresponding to a segment of the outside annular surface illumination light-source device 6D. FIG. 10B is a light-guide reflection plate 40*f* corresponding to a segment of the inside round surface illumination light-source device 6F and is the same as that in FIG. 8. In other words, in the case of the annular surface illumination light-source devices 6D and 6E in which the point light source 36 is disposed on the flat plate 35, the center reflection parts 39*d* and 39*f* to which light emitted from the point light source 36 is applied include non-penetrating holes. The outer reflection parts 38*d* and 38*f* include round through-holes. When the point light source is disposed on the lateral plate, the light-guide reflection plate 40 may have a pattern in which round through-holes are formed on the entire area.

Alternative Example 2

Figure 11:
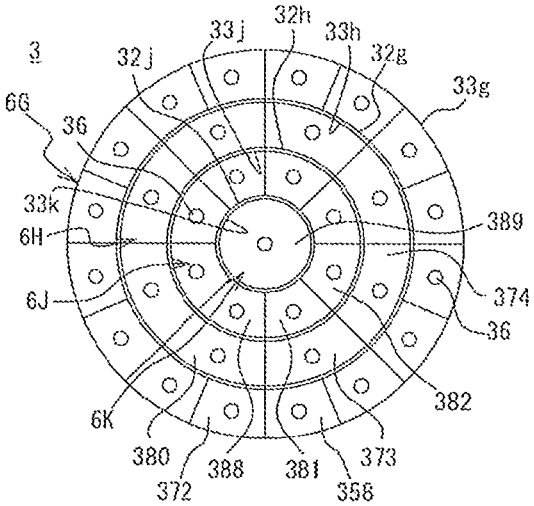
FIG. 11 is a plan view of an alternative example of the surface illumination light-source device of the third embodiment of the invention.

An alternative example 2 of the third embodiment described above of the invention will be described with reference to FIGS. 11 and 12. The annular surface illumination light-source device in FIGS. 11 and 12 is shown by the layout of the casings. In a surface illumination fixture 3 of the alternative example, three annular surface illumination light-source devices 6G, 6H, and 6J having different diameters are concentrically disposed. In the example, the outside annular surface illumination light-source device 6G is divided into sixteen segments 357 to 372 and each segment includes one point light source 36. The intermediate annular surface illumination light-source device 6H is divided into eight segments having a slightly larger size than that of the outside segment and each of the segments 373 to 380 includes one point light source 36. The inside annular surface illumination light-source device 6J is divided into eight segment and each of the segments 381 to 388 includes one point light source 36. The disposed position of the point light source 36 is the flat plate 35. In this manner, in a surface illumination device 1, three annular surface illumination light-source devices 6F, 6G, and 6H are disposed in a triple annular manner and a round surface illumination light-source device 6K is disposed at the center part. Such a structure can enlarge the area of surface illumination and can variously change brightness.

FIG. 12 is a partial plan view of the light-guide reflection plate in FIG. 11. FIG. 12A is a part of the light-guide reflection plate corresponding to a segment of the outside annular surface illumination light-source device 6G and is the same as that in FIG. 4. A center reflection part 39*g* includes non-penetrating holes and an outer reflection part 38*g* includes round through-holes. Although not shown in the drawings, a light-guide reflection plate corresponding to a segment of each of the intermediate surface illumination light-source device 6H and the inside annular surface illumination light-source device 6J has a similar structure to that corresponding to a segment of the outside annular surface illumination light-source device 6G. FIG. 12B is the light-guide reflection plate corresponding to the center round surface illumination light-source device 6K and has a pattern corresponding to one point light source 36 disposed at the center. A center reflection part 39*k* includes non-penetrating holes and an outer reflection part 38*k* includes round through-holes.

In FIG. 11, the annular surface illumination light-source device of the alternative example 2 has a casing having an annular shape. In actual production, however, the casing is typically designed and produced to have a polygonal and approximately annular shape as shown in FIG. 3 and the third embodiment includes such a case. Needless to say, in this case, the round surface illumination light-source device 6K is also formed to have a polygonal outer shell.

In the third embodiment, the casing and the light-guide reflection plate of the surface illumination fixture 3 are formed by a member having a high light reflectance and a low light transmittance, and the light-guide reflection plate is formed so as to have a lower light reflectance and a higher light transmittance as the distance from each point light source increases. The surface illumination fixture that uses light from the point light source at high efficiency and can provide uniform illumination light on a face set apart from an emitting surface of the point light source by a predetermined distance while suppressing the generation of glare in a light emitting direction can be therefore provided.

According to the third embodiment, by combination of the annular surface illumination light-source devices and the round surface illumination light-source device, a disc-shaped surface illumination fixture having a large illumination area can be provided.

Fourth Embodiment

Next, a surface illumination light-source device in a fourth embodiment will be described with reference to FIG. 13. FIG. 13 is an exterior perspective view of the surface illumination light-source device of the fourth embodiment, FIG. 13B is a sectional view taken along the line XIIIB-XIIIB in FIG. 13A, and FIG. 13C is a sectional view of an alternative example.

In a surface illumination light-source device 6J of the fourth embodiment, a light shielding plate 7 having a predetermined height stands in an upright manner from both an internal lateral plate part 32 and an outer lateral plate part 33. The direction of light output from a light-guide reflection plate 40 can be limited to a face opposed to the light-guide reflection plate 40 by the attachment of the light shielding plate 7. By the attachment of the light shielding plate 7 to limit the light emission direction, an area that is expected to be illuminated alone can be illuminated, thereby reducing the probability of direct sight of an emitting face. Such a surface illumination fixture can therefore reduce the burden of light placed on the eyes.

The size of an illuminating area is determined depending on the height of the light shielding plate. In the embodiment, the light shielding plate 7 has a height of 2 cm. The height of the light shielding plate 7 is preferably $1/\sqrt{3}$ time to the same as the length of the flat plate part in the surface illumination light-source device. In other words, in a sectional view passing through the center of the light source device and in parallel with the lateral plate part, the angle θ between a straight line passing through one edge of a lateral plate part and through the upper part of a light shielding plate standing from the lateral plate part on the other edge, and the light-guide reflection plate is preferably 30° degree to 45°. A light shielding plate having a height less than the above cannot sufficiently limit the illumination area of illumination light. A light shielding plate having a height more than the above increases the proportion of reflected light by the light shielding plate and the illumination direction is unlikely to be controlled. This makes the limitation range of illumination light unclear.

As shown in FIG. 13C, the light shielding plate 7 may be attached apart from the internal lateral plate part 32 and the outer lateral plate part 33 by a predetermined distance. When the light shielding plate 7 is attached set apart, light leaks from the gap between the light shielding plate 7 and each lateral plate part to provide indirect illumination, thereby increasing illumination intensity without direct illumination to an illumination area. In addition, light is not reflected by the light shielding plate 7 near the light-guide reflection plate 40 and the illumination direction is unlikely to be spread.

Fifth Embodiment

Figure 14:
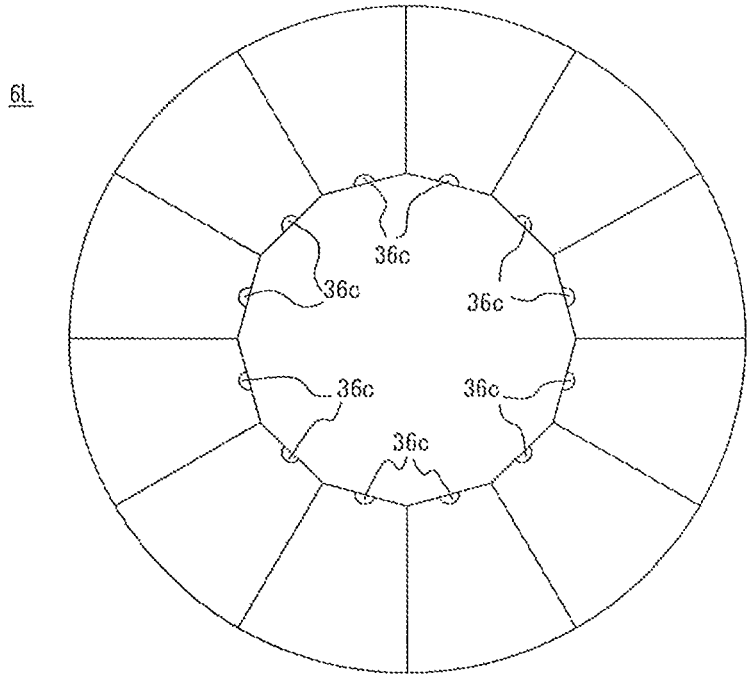
FIG. 14 is a plan view of a surface illumination light-source device of a fourth embodiment of the invention.
Figure 15:
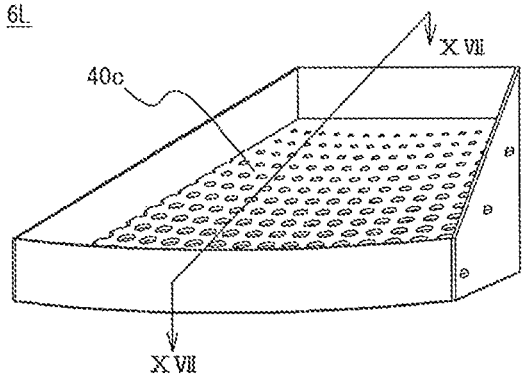
FIG. 15 is a partially enlarged perspective view of a segment of the surface illumination light-source device in FIG. 14.
Figure 16:
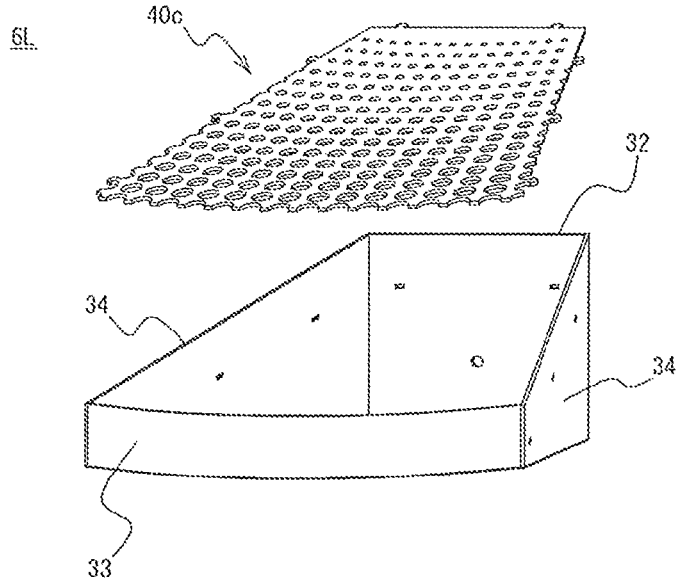
FIG. 16 is an exploded perspective view of the segment in FIG. 15.
Figure 18:
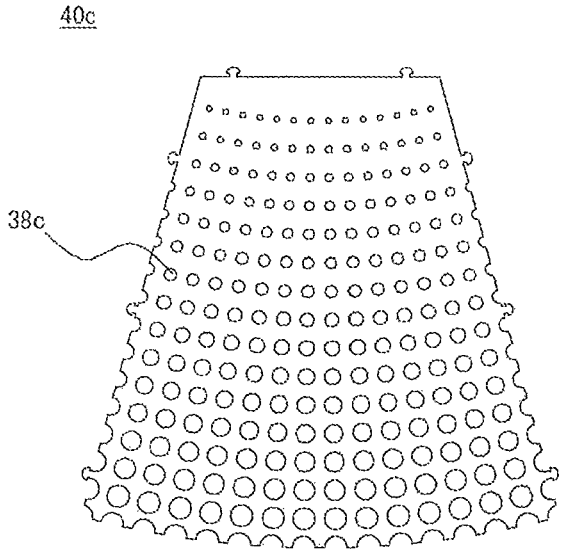
FIG. 18 is a plan view of a light-guide reflection plate of the surface illumination light-source device in FIG. 15.
Figure 19:
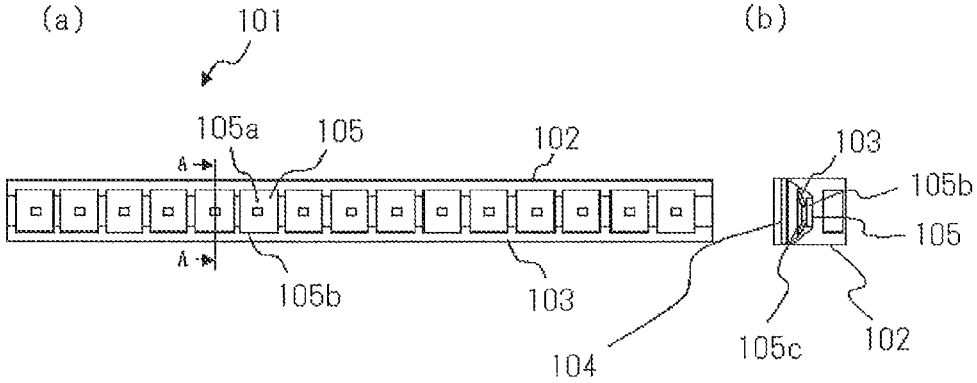
FIG. 19 is a plan view of a related art illumination device using LEDs.
Figure 20:
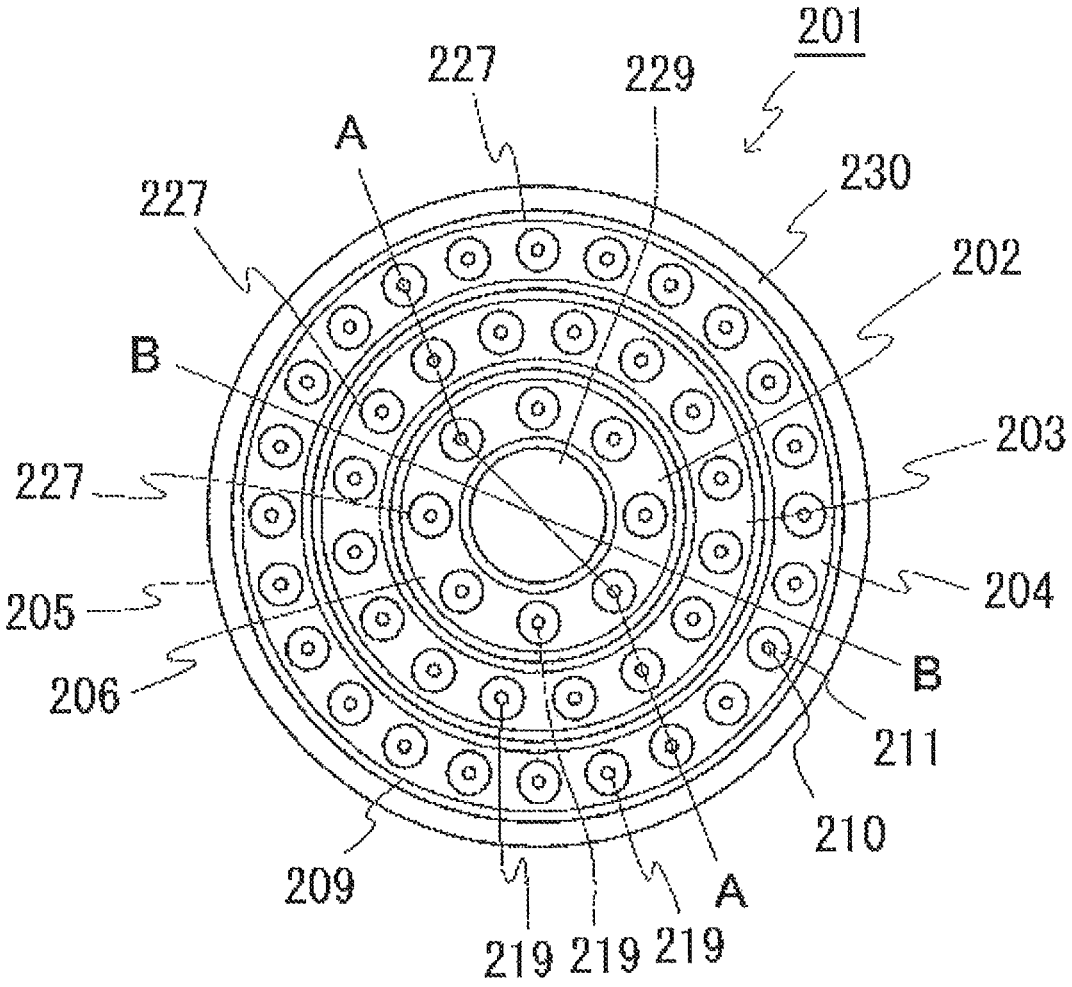
FIG. 20 is a plan view of another related art illumination device using LEDs.

Next, a surface illumination light-source device in a fifth embodiment will be described with reference to FIGS. 14 to 18. FIG. 14 shows the layout of casings of the surface illumination light-source device in the fifth embodiment. FIG. 15 is a partially enlarged perspective view of a segment. FIG. 16 is an exploded perspective view of the segment in FIG. 15. FIG. 17A is a sectional view taken along the line XVII-XVII in FIG. 15, FIG. 17B is a sectional view of an alternative example of the embodiment. FIG. 18 is a plan view of the light-guide reflection plate in FIG. 15.

In the surface illumination light-source device of the fifth embodiment, an annular surface illumination light-source device 6L is divided into twelve segments and each segment has an internal lateral plate provided with one point light source 36*c*. The disposed position of the point light source 36*c* is not limited to the flat plate and the internal lateral plate and may be the outer lateral plate. A plurality of point light sources are disposed on the internal lateral plate of one segment and LEDs in a line may be used. An illumination fixture main body is not shown in drawings.

In the embodiment, the height of the casing is gradually reduced outward. The flat plate is not parallel with respect to the light-guide reflection plate and is tilted by a predetermined angle. Such a structure enables efficient reflection of light emitted from the point light source by the flat plate toward the light-guide reflection plate side. The partition plate for segments may not be provided.

In the embodiment, the outer lateral plate is formed by a member having a higher light transmittance than those of the flat plate and the internal lateral plate. This prevents the outer space of the outer lateral plate apart from the point light source from becoming too dark.

In the light-guide reflection plate 40*c*, a fan-shaped light-guide reflection unit corresponding to a segment has a different pattern of openings for passing light from that of openings for passing light provided on each light-guide reflection unit in other embodiments. In other words, round through-holes

38*c* are formed on the entire area of the light-guide reflection plate 40*c* because the point light source is disposed on the internal lateral plate part. The through-holes 38*c* are provided in a concentric arc pattern and have a small diameter near the point light source 36. Such a structure can provide uniform illumination light over the entire illumination area. In order to suppress excessive brightness in an area on the light-guide reflection plate corresponding to an optical axis of the point light source, the light-guide reflection plate may have smaller openings in the area corresponding to the optical axis.

The flat plate part 35*c* of the embodiment is formed to be closer to the light-guide reflection plate as the distance from the point light source 36*c* increases. Thus, the internal lateral plate part has a height H of 2 cm and the outer lateral plate part has a height h of 1 cm. The flat plate part 35*c* is not parallel with the light-guide reflection plate and the distance between the light-guide reflection plate and the flat plate part is reduced as the distance from the point light source increases. By forming such a structure, light from the point light source can reach a distant point without reduction in intensity, thereby readily providing uniform illumination intensity over the entire area. When the distance between the light-guide reflection plate and the flat plate part is zero, light is not properly reflected, thereby becoming dark. Hence, the distance between the light-guide reflection plate and the flat plate part is preferably 2 mm or more even at a position having the smallest distance.

As shown FIG. 17B, the point light source 36 may be attached onto the flat plate part 35*c*. In this case, the flat plate part 35*c* is formed to be parallel with the light-guide reflection plate 40*c* in a predetermined range from the point light source 36 and to be closer to the light-guide reflection plate as the distance from the point light source 36*c* increases.

Sixth Embodiment

According to a sixth embodiment of the invention, as shown in FIG. 1B, in the surface illumination fixture of the invention, the surface illumination fixture is provided with a diffusion plate 4 and a light-guide reflection plate 40 is disposed between a point light source 36 and the diffusion plate 4. By forming such a structure, light passed through the light-guide reflection plate is further diffused by the diffusion plate, thereby providing a surface illumination effect having soft light.

Seventh Embodiment

According to a seventh embodiment of the invention, in a surface illumination device using the surface illumination fixture of the invention, a cover such as a lamp shade is attached onto a back face of the surface illumination fixture, thereby providing a surface illumination device effectively using emission light and providing substantially uniform illumination light over the entire area.

Eighth Embodiment

According to an eighth embodiment of the invention, in a surface illumination device using the surface illumination fixture of the invention, a panel is attached onto a front face of the surface illumination fixture. The panel may be a decorative panel or may be a lamination panel on the diffusion plate for protecting the diffusion plate. By the attachment of the panel onto a front face of the surface illumination fixture, the surface illumination fixture is used to provide a surface illumination device that can provide substantially uniform illumination light over the entire area.

The embodiments of the invention have been described hereinbefore, but the invention is not limited to the above described embodiments and may have various configurations without departing from the scope of the invention.

For example, the shape of the through-hole on the light-guide reflection plate may be selected from, for example, a round shape, an elliptical shape, polygonal shapes such as a triangular shape, a rectangular shape, and a hexagonal shape, and from a shape having a small width, such as an arc shape and a zigzag shape. The layout can be selected as needed from various patterns such as a matrix pattern and a staggered pattern. The opening in the center part can be selected from a non-penetrating hole, an arc-shaped through-hole, a round through-hole, and other through-holes depending on luminance of the light-guide reflection plate.

According to the invention, the annular surface illumination light-source device includes a casing formed into an annular shape and a light-guide reflection plate. The annular surface illumination light-source device can be therefore replaced with a currently used illumination fixture using annular fluorescent lamps and provides the possibility to produce new designs by combination with a round surface illumination light-source device.

EXPLANATIONS OF LETTERS OR NUMERALS

1 surface illumination device
2 illumination cover
3 surface illumination fixture
4 diffusion plate
5 hanging cord
6 surface illumination light-source device
6A, 6B, 6D, 6E annular surface illumination light-source device
6C, 6F, 6K round surface illumination light-source device
30 casing
32, 32*a*, 32*b* internal lateral plate part
33, 33*a*, 33*b* outer lateral plate part
34 partition plate
35, 35*a*, 35*b* flat plate part
36, 36*a*, 36*b* point light source
38, 38*a* outer reflection part
39 center reflection part
40, 40*a*, 40*b* light-guide reflection plate
40U light-guide reflection unit
41 illumination fixture main body
50 lighting circuit
30*c* round casing
33*c* outer lateral plate part
34*c* partition plate
35*c* flat plate part
38*c* outer reflection part
39*c* center reflection part
40*c* round light-guide reflection plate
42 intermediate reflection part
7 light shielding plate

The invention claimed is:

1. A surface illumination fixture comprising:

a surface illumination light-source device converting light from a point light source having strong directivity into surface illumination; and an illumination fixture main body holding the surface illumination light-source device, the surface illumination light-source device including a casing having a flat plate part being used to attach the surface illumination light-source device to the illumination fixture main body, a lateral plate part standing from the flat plate part, and an opening on a surface opposite to the flat plate part, and including a plurality of such point light sources disposed on the flat plate part, and a light-guide reflection plate covering the opening, the casing and the light-guide reflection plate being formed by members having a high light reflectance and a low light transmittance, the light-guide reflection plate being divided into regions corresponding to the point light sources, and each region being formed to have a lower light reflectance and a higher light transmittance as the distance from the corresponding point light source increases, wherein the casing and the light-guide reflection plate are formed into an annular shape.

2. The surface illumination fixture according to claim 1, wherein each of the casing and the light-guide reflection plate has a surface coated with a flame-retardant light-transmissive material.

3. The surface illumination fixture according to claim 1, wherein a plurality of such surface illumination light-source devices are concentrically disposed.

4. The surface illumination fixture according to claim 1, wherein a lighting device for a point light source is attached to a center opening of the casing of the surface illumination light-source device disposed to the illumination fixture main body.

5. The surface illumination fixture according to claim 1, wherein the casing and the light-guide reflection plate are formed by an ultrafinely foamed reflection member.

6. The surface illumination fixture according to claim 1, further comprising a light shielding plate having a predetermined height and standing from the lateral plate part in an upright manner.

7. The surface illumination fixture according to claim 6, wherein a gap is provided between the light shielding plate and the lateral plate part.

8. A surface illumination device comprising:

the surface illumination fixture as claimed in claim 1; and a diffusion plate disposed on a front face of the surface illumination fixture.

9. The surface illumination device according to claim 8, further comprising a cover on a back face of the surface illumination fixture.

10. The surface illumination device according to claim 8, further comprising a panel on a front face of the diffusion plate.

11. A surface illumination fixture comprising:

a surface illumination light-source device converting light from a point light source having strong directivity into surface illumination; and an illumination fixture main body holding the surface illumination light-source device, the surface illumination light-source device including a casing having a flat plate part being used to attach the surface illumination light-source device to the illumination fixture main body, a lateral plate part standing from the flat plate part, and an opening on a surface opposite to the flat plate part, and including a plurality of such point light sources disposed on the flat plate part, and a light-guide reflection plate covering the opening, the casing and the light-guide reflection plate being formed by members having a high light reflectance and a low light transmittance, the light-guide reflection plate being divided into regions corresponding to the point light sources, and each region being formed to have a lower light reflectance and a higher light transmittance as the distance from the corresponding point light source increases, wherein the casing and the light-guide reflection plate are formed into a disc shape.

12. A surface illumination fixture comprising:

a surface illumination light-source device converting light from a point light source having strong directivity into surface illumination; and an illumination fixture main body holding the surface illumination light-source device, the surface illumination light-source device including a casing having a flat plate part being used to attach the surface illumination light-source device to the illumination fixture main body, a lateral plate part standing from the flat plate part, and an opening on a surface opposite to the flat plate part, and including a plurality of such point light sources disposed on the flat plate part, and a light-guide reflection plate covering the opening, the casing and the light-guide reflection plate being formed by members having a high light reflectance and a low light transmittance, the light-guide reflection plate being divided into regions corresponding to the point light sources, and each region being formed to have a lower light reflectance and a higher light transmittance as the distance from the corresponding point light source increases, wherein the casing includes partition plates dividing the point light sources and standing from the flat plate part in an upright manner, and the partition plates divide the casing into segments.

13. The surface illumination fixture according to claim 12, wherein each segment is formed to have the same size and the same shape.

14. A surface illumination fixture comprising:

a surface illumination light-source device converting light from a point light source having strong directivity into surface illumination; and an illumination fixture main body holding the surface illumination light-source device, the surface illumination light-source device including a casing having a flat plate part being used to attach the surface illumination light-source device to the illumination fixture main body, a lateral plate part standing from the flat plate part, and an opening on a surface opposite to the flat plate part, and including a plurality of such point light sources disposed on the flat plate part, and a light-guide reflection plate covering the opening, the casing and the light-guide reflection plate being formed by members having a h light reflectance and a low light transmittance, the light-guide reflection plate being divided into regions corresponding to the point light sources, and each region being formed to have a lower light reflectance and a higher light transmittance as the distance from the corresponding point light source increases, wherein the surface illumination light-source device includes both the casing and the light-guide reflection plate each having an annular shape, and the casing and the light-guide reflection plate each having a disc shape.

* * * * *